US007716769B2

(12) United States Patent
Ha et al.

(10) Patent No.: US 7,716,769 B2
(45) Date of Patent: May 18, 2010

(54) WASHING MACHINE AND SUDS REMOVAL METHOD THEREOF

(75) Inventors: Yo Chul Ha, Suwon-Si (KR); Chang Joo Chai, Suwon-Si (KR); Hyeon Seok O, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 729 days.

(21) Appl. No.: 11/281,516

(22) Filed: Nov. 18, 2005

(65) Prior Publication Data

US 2006/0248658 A1 Nov. 9, 2006

(30) Foreign Application Priority Data

May 4, 2005 (KR) ..... 10-2005-0037727

(51) Int. Cl.
*D06F 33/00* (2006.01)

(52) U.S. Cl. ..... 8/158

(58) Field of Classification Search ..... 8/147, 8/158, 159; 68/12.02, 208
See application file for complete search history.

(56) References Cited

U.S. PATENT DOCUMENTS

| | | | | |
|---|---|---|---|---|
| 5,038,586 | A * | 8/1991 | Nukaga et al. | 68/12.01 |
| 5,596,889 | A * | 1/1997 | Guerra et al. | 68/12.02 |
| 5,890,247 | A * | 4/1999 | Erickson et al. | 8/158 |
| 6,269,666 | B1 * | 8/2001 | Whah et al. | 68/12.02 |
| 6,393,872 | B2 * | 5/2002 | Whah et al. | 68/12.02 |
| 6,584,811 | B2 * | 7/2003 | Whah et al. | 68/12.04 |
| 6,591,439 | B2 * | 7/2003 | Whah et al. | 8/159 |
| 6,626,013 | B2 * | 9/2003 | Ohta et al. | 68/12.27 |
| 2003/0024055 | A1 * | 2/2003 | Broker et al. | 8/158 |
| 2006/0195989 | A1 * | 9/2006 | Jeong | 8/158 |

* cited by examiner

*Primary Examiner*—Joseph L Perrin
(74) *Attorney, Agent, or Firm*—Staas & Halsey LLP

(57) ABSTRACT

A washing machine and suds removal method thereof. The suds removal method is designed to effectively remove suds at the earliest possible time using a small amount of water by adjusting an activity of suds when the generation of suds is sensed. The suds removal method includes sensing the generation of suds during a washing cycle, and removing the suds by adjusting the activity of suds when the generation of suds is sensed.

16 Claims, 14 Drawing Sheets

WASHING MACHINE AND SUDS REMOVAL METHOD THEREOF

CROSS-REFERENCE TO RELATED APPLICATIONS

This application claims the benefit of Korean Patent Application No. 10-2005-37727, filed on May 4, 2005 in the Korean Intellectual Property Office, the disclosure of which is incorporated herein by reference.

BACKGROUND OF THE INVENTION

1. Field of the Invention

The present invention relates to a suds removal method of a washing machine, and, more particularly, to a washing machine and a suds removal method thereof which can effectively remove suds by adjusting an activity of the suds upon generation thereof.

2. Description of the Related Art

In general, a conventional drum-type washing machine, washes laundry by raising and dropping the laundry contained in a cylindrical rotating drum through rotation of the drum. The drum-type washing machine reduces cloth damage and water consumption as compared to a conventional pulsator-type washing machine, although it has a long wash time. Thus, the demand for drum-type washing machines is increasing.

In the conventional washing machine, if excess detergent is used or a detergent, which tends to generate large quantities of suds, is used, excess suds are generated due to residual detergent component inside a water tub or laundry during a spin-drying cycle after drainage of water. The generated suds leak from a front side of the washing machine, for example, via a detergent input opening. Moreover, an excess of suds acts as a load which deteriorates a drive of a motor of the washing machine, thereby making it impossible to achieve normal revolutions per minute for a spin-drying cycle.

To solve this problem, Korean Registered Patent Publication 10-282343 discloses a method of sensing a generation of suds to thereby remove the suds.

In operation of a conventional washing machine disclosed in the above Patent Publication, an increase of a load applied to a motor is sensed to determine whether suds are generated. When the suds are generated, a predetermined suds removal cycle, which is a repetition of water supply, washing, water drainage, and spin-drying operations in this sequence, is performed to thereby remove the suds.

However, the suds removal cycle of the conventional washing machine as stated above, does not take into account the amount of suds corresponding to the amount of a detergent, and simply repeatedly performs a rinsing operation, including water supply, washing, water drainage, and spin-drying operations, for a predetermined time to rapidly remove suds. Therefore, when excess detergent is used, part of the detergent may remain depending on the amount of water supplied to remove suds. This results in a failure to completely remove the suds even after completion of the suds removal cycle. Also, when only a small amount of detergent is used to thereby generate a small quantity of suds, the suds removal cycle must be continued for a predetermined time even after the small quantity of suds is completely removed, resulting in unnecessary consumption of time and water.

In addition, when excess detergent is used, a large amount of water is required to remove suds, exerting a negative influence on rinsing and spin-drying performances.

SUMMARY OF THE INVENTION

Accordingly, it is an aspect of the present invention to provide a washing machine and suds removal method thereof, which can remove suds at the earliest possible time using a small amount of water by adjusting an activity of suds upon generation thereof.

Additional aspects and/or advantages of the invention will be set forth in part in the description which follows and, in part, will be apparent from the description, or may be learned by practice of the invention.

These and/or other aspects of the present invention are achieved by providing a washing machine and suds removal method thereof, which can effectively remove a residual detergent in a water tub and laundry by adjusting a supply amount of water and an operation rate of a motor at each operation of a suds removal cycle.

It is another aspect of the present invention to provide a washing machine and suds removal method thereof, which checks the residual amount of suds at any time during a suds removal cycle to determine whether to continue or stop the suds removal cycle depending on the checked residual amount of suds, thereby reducing unnecessary consumption of time and water.

It is yet another aspect of the present invention to provide a washing machine and suds removal method thereof, which displays a "suds" mark only when suds are sensed via a suds residue test during a suds removal cycle.

The foregoing and/or other aspects are achieved by providing a suds removal method of a washing machine including sensing a generation of suds during a washing cycle, and removing the suds by adjusting an activity of the suds when the generation of suds is sensed.

The sensing of the generation of suds includes primarily sensing the generation of suds by detecting a torque variation of a motor of the washing machine during the washing cycle, and secondarily sensing the generation of suds by performing a drainage operation after ending the washing cycle when the generation of suds is primarily sensed.

The primary sensing of the generation of suds includes determining whether a torque of the motor is reduced beyond a predetermined variation rate o, thereby sensing the generation of suds when the torque of the motor is reduced beyond the predetermined variation rate. The predetermined variation rate is approximately 10%.

The secondary sensing of the generation of suds includes determining whether water reaches a drainage ending level within a predetermined drainage time during the drainage operation, thereby sensing the generation of suds when the water does not reach the drainage ending level within the predetermined drainage time.

The washing cycle may be a preliminary washing cycle or a main washing cycle.

The removal of suds includes determining whether the washing cycle is the preliminary washing cycle, and stopping an operation of drive units when the washing cycle is the preliminary washing cycle, thereby lowering an activity of suds.

The removal of suds further includes determining whether the washing cycle is the main washing cycle, and performing a suds removal cycle when the washing cycle is the main washing cycle, to differently adjust the activity of suds at each operation of the method, thereby removing the suds.

The activity of suds is adjusted depending on the supply amount of water and an operation rate of the motor.

The suds removal cycle further includes a water tub washing operation to remove a detergent remaining in a water tub by successively performing a water supply operation, an agitating operation, and a drainage operation, a laundry washing operation to remove a detergent remaining in laundry by successively performing water supply and agitating operations, and a suds removal operation to remove the detergent remaining in both the water tub and laundry by increasing the supply amount of water and an operation rate of the motor while successively performing the water supply and agitating operations.

The suds removal cycle further includes inputting a bleach or rinse agent during the water supply operation to reduce the activity of suds.

The suds removal cycle further includes a rinsing operation to remove the suds remaining in the water tub and the laundry by successively performing the water supply and agitating operations.

The suds removal operation determines whether the suds removal cycle is to be continued or stopped by inspecting a residual amount of the suds in the middle of the suds removal cycle.

The suds removal operation displays a "suds" mark that indicates the presence of suds if the residual amount of suds is sensed in the suds residue inspection.

The suds removal operation measures a time required to reach a drainage ending level when a drainage pump is continuously turned on after completing a spin-drying cycle, thereby ending the suds removal cycle when water reaches the drainage ending level within a predetermined drainage time.

The suds removal cycle may progress to a rinsing operation if the water does not reach the drainage ending level within the predetermined drainage time.

The suds removal cycle further includes an idling operation to reduce the activity of suds via a pressure variation inside the water tub by controlling turning on/off of a drainage device, and the idling operation may stop all the drive units except for the drainage device.

The foregoing and/or other aspects are achieved by providing a washing machine having a motor and a drainage device, the washing machine including an electric current sensor to detect a torque variation of the motor during a washing cycle, and a controller to determine whether a torque of the motor is reduced beyond a predetermined variation rate, thereby ending the washing cycle when the torque of the motor is reduced beyond the predetermined variation rate and performing a drainage operation to thereby sense a generation of suds.

The controller determines whether water reaches a drainage ending level within a predetermined drainage time during the drainage operation, thereby sensing the generation of suds when the water does not reach the drainage ending level within the predetermined drainage time.

The controller performs a suds removal cycle that adjusts an activity of the suds when the generation of suds is sensed to thereby remove the suds, and may determine whether the suds removal cycle is continued or ended by inspecting a residual amount of suds in the middle of the suds removal cycle.

The suds removal cycle adjusts the activity of suds by controlling a supply amount of water and an operation rate of the motor.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
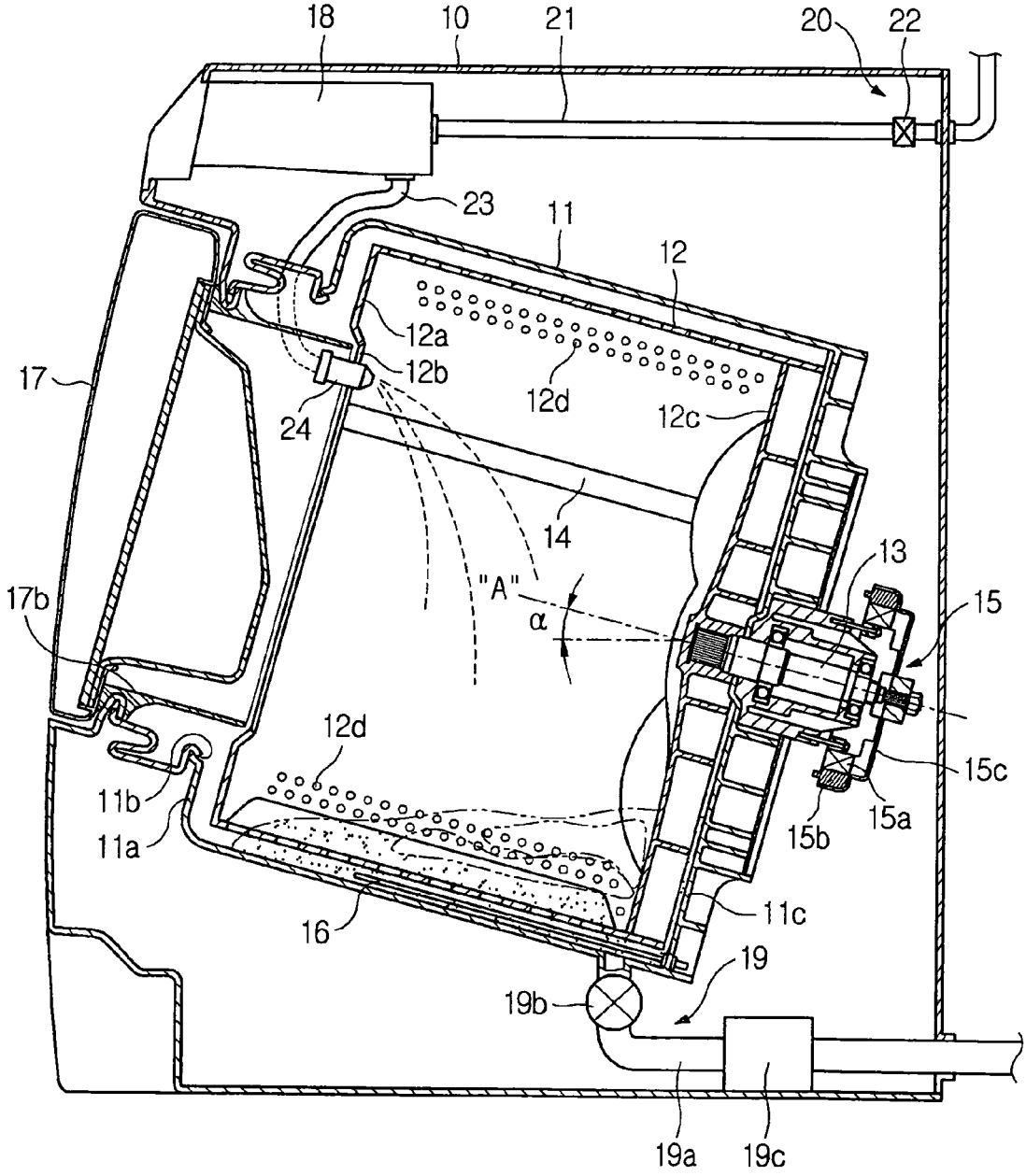
FIG. 1 is a sectional view illustrating a washing machine according to an embodiment of the present invention.

Reference will now be made in detail to the embodiment of the present invention, an example of which is illustrated in the accompanying drawings, wherein like reference numerals refer to like elements throughout. The embodiment is described below to explain the present invention by referring to the figures.

FIG. 1 is a sectional view illustrating a washing machine according to an embodiment of the present invention.

In FIG. 1, the washing machine of the present invention comprises a drum-shaped water tub 11 mounted in a body 10 to contain wash water therein, and a rotating drum 12 rotatably mounted in the water tub 11.

The water tub 11 is generally tilted relative to a washing machine mounting plane by a predetermined inclination "α" so that a front surface 11*a* thereof, formed with an opening 11*b*, is positioned higher than a rear surface 11*c* thereof. In the same manner as the water tub 11, the rotating drum 12, mounted in the water tub 11, is tilted so that a front surface 12*a* thereof, formed with an opening 12*b*, is positioned higher than a rear surface 12*c* thereof.

That is, the rotating drum 12 is mounted so that a rotating center axis "A" thereof is tilted relative to the washing machine mounting plane by the predetermined inclination "a" to thereby allow the front surface 12*a* thereof formed with the opening 12*b* to face up and to the front. The rotating drum 12 comprises a rotating shaft 13, which is coupled to a center of the rear surface 12*c* thereof. As the rotating shaft 13 is rotatably supported at the center of the rear surface of the water tub 11, the rotating drum 12 is rotatable inside the water tub 11.

A plurality of through-holes 12*d* is formed at a circumferential wall of the rotating drum 12. Also, a plurality of lifters 14 is mounted at an inner surface of the rotating drum 12 to raise and drop laundry upon rotation of the rotating drum 12.

A motor 15 is mounted at the outside of the rear surface 11*c* of the water tub 11. The motor 15 serves as a drive unit to rotate the rotating shaft 13 connected to the rotating drum 12, resulting in washing, rinsing and spin-drying operations of the washing machine. A heater 16 is mounted in a bottom region of the water tub 11 to heat wash water supplied to the water tub 11.

The motor 15 comprises a stator 15*a* affixed to the rear surface 11*c* of the water tub 11, a rotor 15*b* rotatably disposed around the stator 15*a*, and a rotating plate 15*c* to connect the stator 15*a* to the rotating shaft 13.

The body 10 comprises an opening 17*b* at a front surface thereof, at a position corresponding to the openings 12*b* and 11*b* of the rotating drum 12 and the water tub 11 to put laundry into the rotating tub 12 or to take the laundry out of the rotating tub 12. A door 17 is mounted at the opening 17*b* to open or close the opening 17*b*.

A detergent supply device 18 and a water supply device 20 are mounted above the water tub 11, and a drainage device 19 is mounted underneath the water tub 11 to drain water inside the water tub 11. The drainage device 19 comprises a drainage pipe 19*a*, a drainage valve 19*b*, and a drainage motor 19*c*.

The detergent supply device 18 is internally sectionalized into a plurality of chambers, and is mounted at the front surface of the body 10 to facilitate the input of a detergent and rinse agent into the respective chambers.

The water supply device 20 comprises a water supply pipe 21 to supply water into the water tub 11, and a water supply valve 22 mounted to the water supply pipe 21 to control the supply of water. The water supply pipe 21 is connected with the detergent supply device 18 to supply water from an exterior water source into the detergent supply device 18. A separate connection pipe 23 is mounted between the detergent supply device 18 and the water tub 11 to supply the water, having passed through the detergent supply device 18, into the water tub 11. A water supply nozzle 24 is mounted at an outlet of the connection pipe 23. Supplying the water into the water tub 11 by way of the detergent supply device 18 allows the detergent inside the detergent supply device 18 to be supplied into the water tub 11 after being dissolved in the water.

Figure 2:
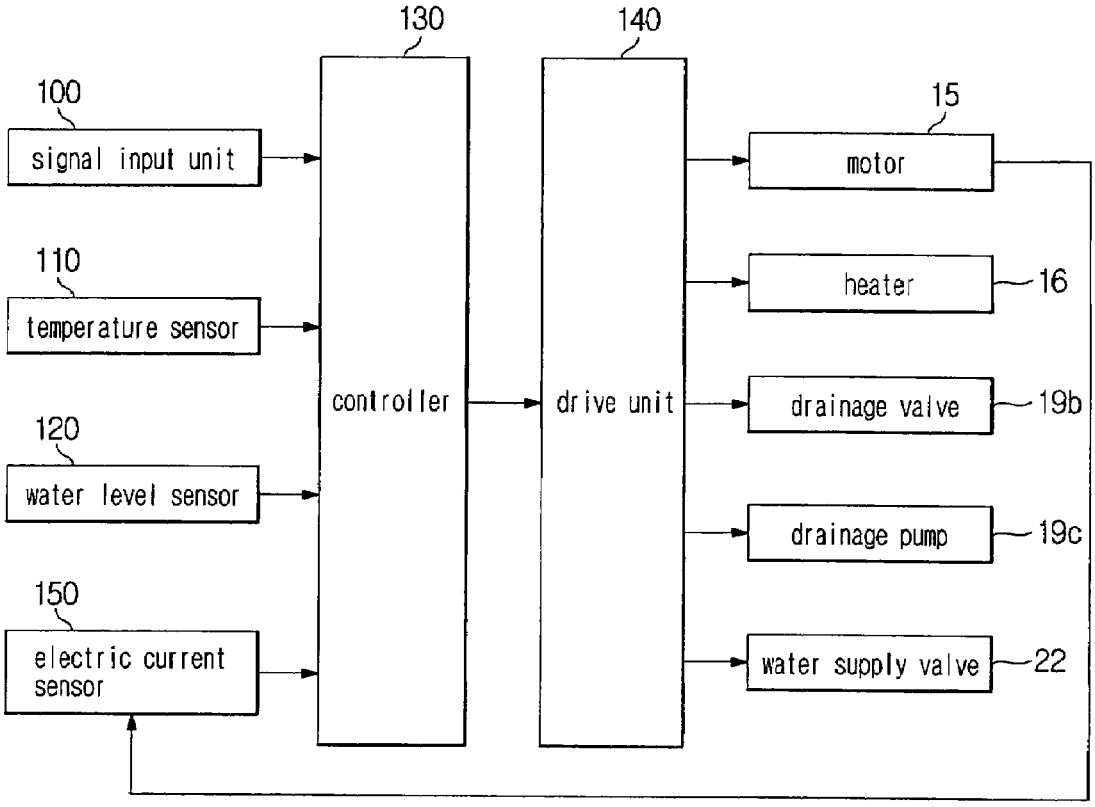
FIG. 2 is a control block diagram illustrating a suds removal apparatus of the washing machine of FIG. 1.

FIG. 2 is a control block diagram illustrating a suds removal apparatus of the washing machine of FIG. 1. As shown in FIG. 2, the suds removal apparatus comprises a signal input unit 100, a temperature sensor 110, a water level sensor 120, a controller 130, a drive unit 140, and an electric current sensor 150.

The signal input unit 100 serves to input various operational information, such as a desired wash course, a temperature of wash water, revolutions per minute for a spin-drying cycle, and addition of a rinsing operation, to the controller 130. The temperature sensor 110 serves to sense the temperature of wash water.

The water level sensor 120 serves to sense the level of wash water inside the water tub 11. Specifically, the water level sensor 120 senses the level of wash water, which varies depending on the drainage amount of wash water and suds during a drainage process, thereby inputting the sensed water level data to the controller 130.

The controller 130 is a micro-computer to primarily sense the generation of suds by detecting a torque variation of the motor 15 during a preliminary washing process or main washing process. When the generation of suds is sensed, the controller 130 forcibly ends the washing process and advances a suds sensing process, i.e. drainage process, to thereby secondarily sense the generation of suds by checking a drainage time. That is, the controller 130 determines generation of suds by checking whether the water reaches a drainage ending level within a predetermined drainage time during the suds sensing process. The controller 130 comprises a timer to time the drainage time, and a ROM table to store various data, such as a preset time or preset water level, depending on a wash course, a capacity of the washing machine, or a capability of the drainage pump 19*c*.

In the embodiment of the present invention, the controller 130 may utilize any one of control methods disclosed in Korean Patent Application NOS. 2005-9573 and 2005-9575 to determine generation of suds during the suds sensing process. Admittedly, any other known techniques may be employed to sense generation of suds.

The drive unit 140 drives the motor 15, heater 16, drainage valve 19*b*, drainage pump 19*c*, and water supply valve 22 based on drive control signals from the controller 130.

The electric current sensor 150 detects a torque current, i.e. a current caused by a rotating force of the motor 15, which varies depending on the amount of suds, thereby detecting a torque of the motor 15. With comparison of a speed-torque character curve of the motor 15, the electric current sensor 150 detects the torque of the motor 15.

Now, the operational sequence and effects of a suds removal method of the washing machine configured as stated above will be described.

Since the technical characteristic of the present invention is a method of effectively sensing and removing suds, the following description describes the suds removal method.

Figure 3:
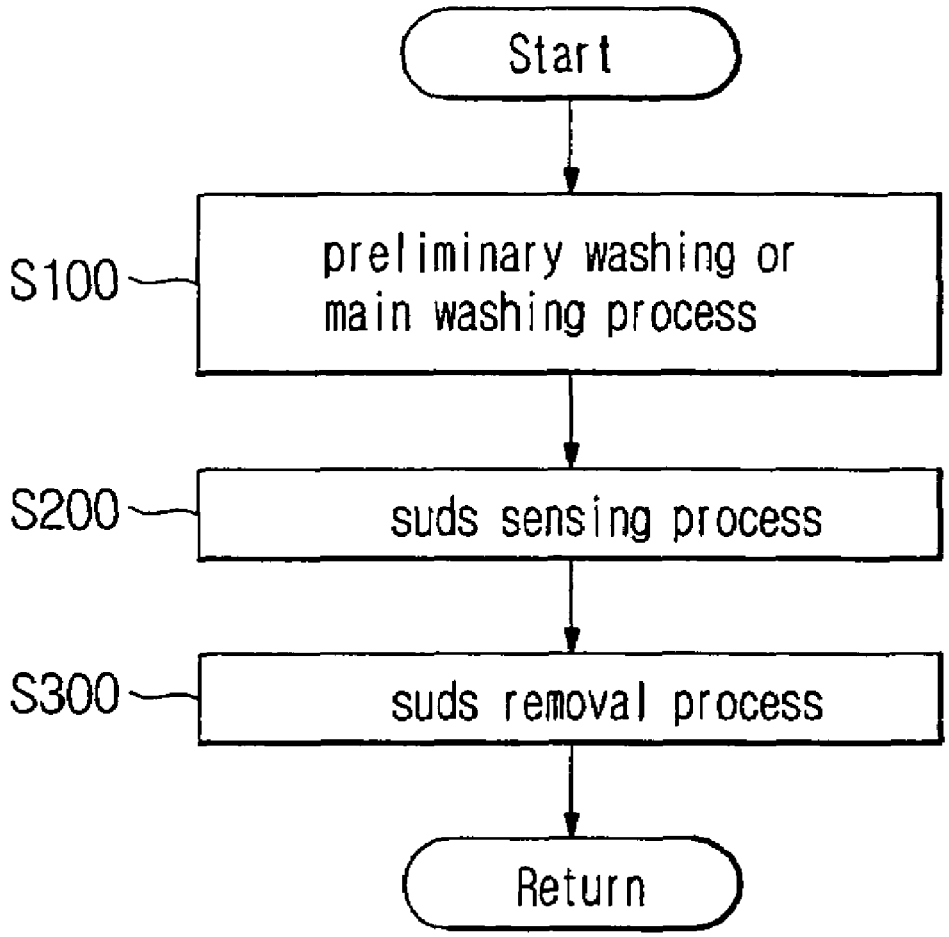
FIG. 3 is a flow chart illustrating a suds removal method of the washing machine according to an embodiment of the present invention.
Figure 4:
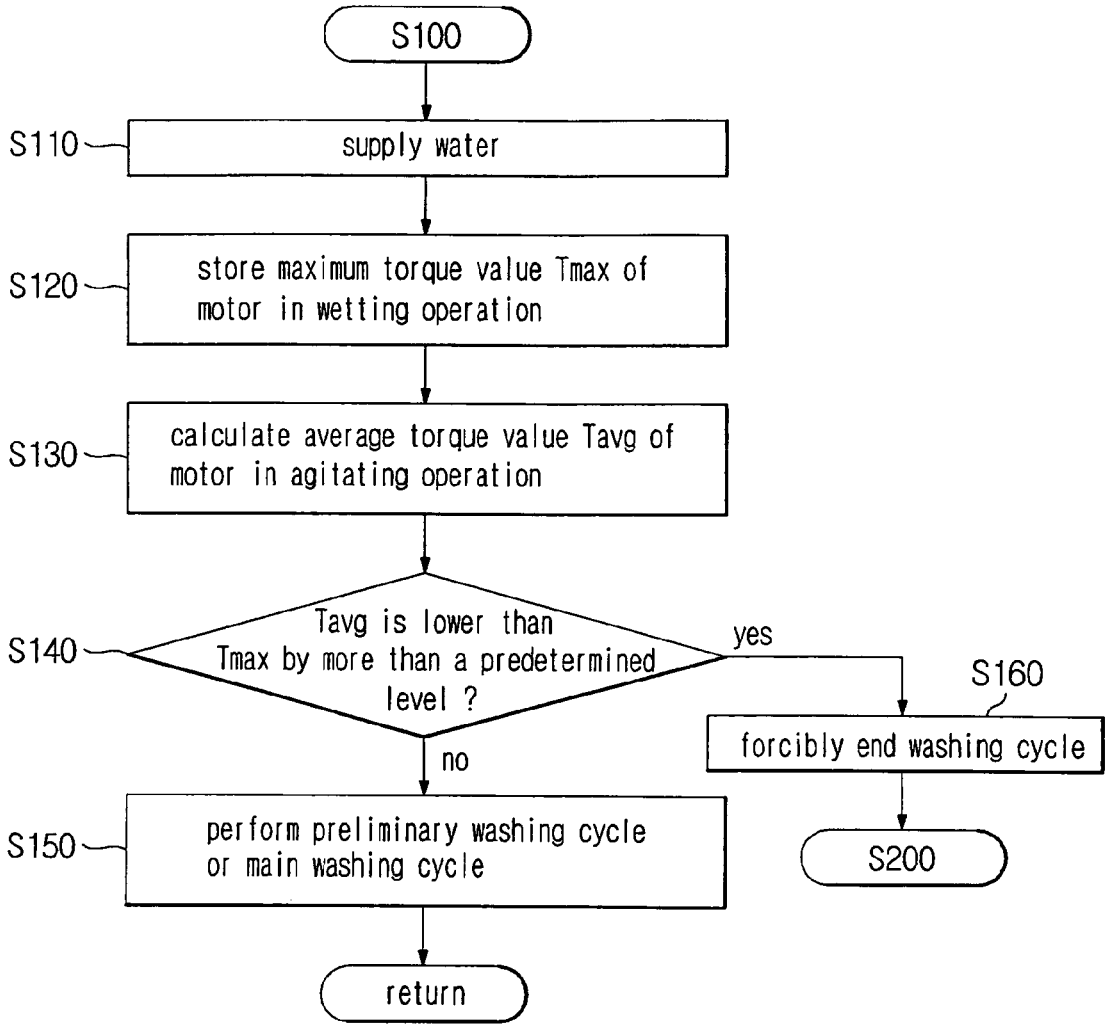
FIG. 4 is a block diagram illustrating a transition from a suds sensing process to a suds removal process associated with a preliminary washing cycle according to an embodiment of the present invention.
Figure 5:
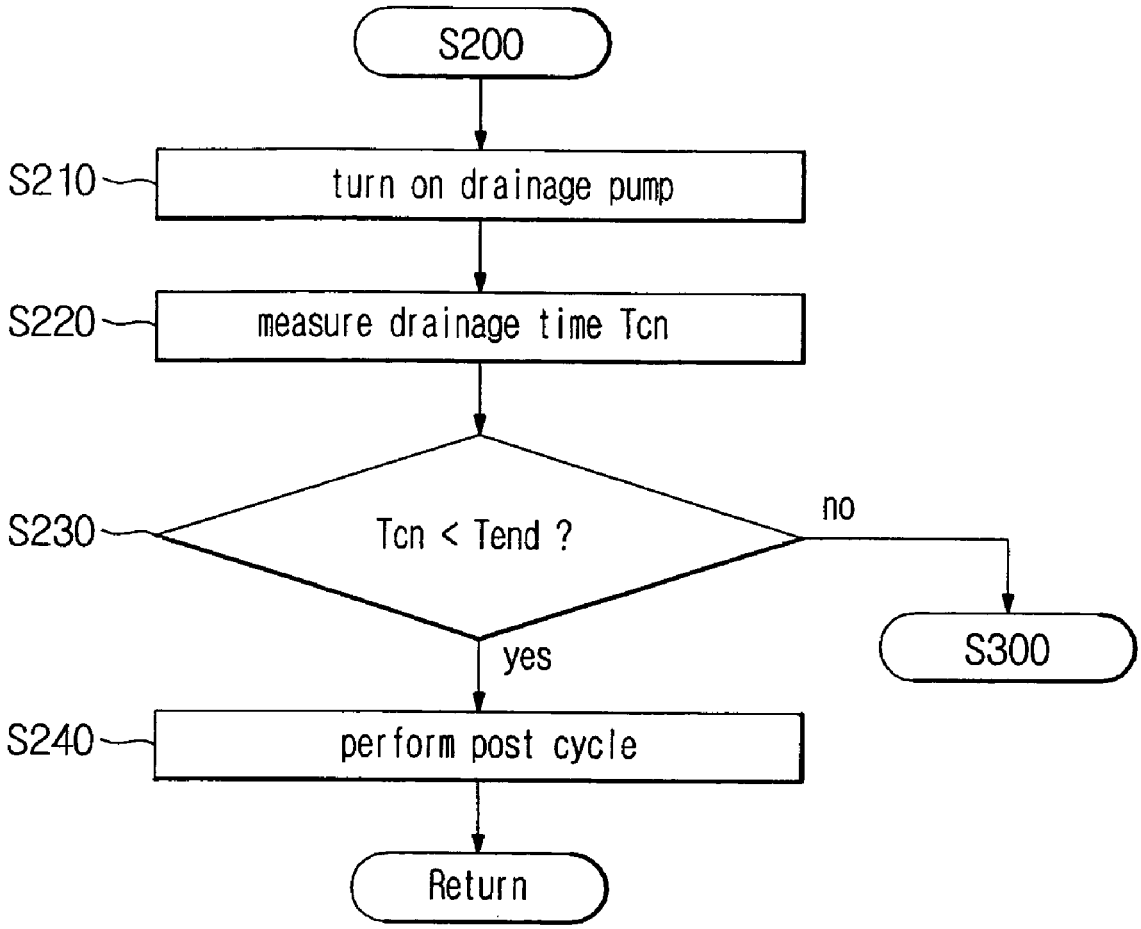
FIG. 5 is a block diagram illustrating a transition from the suds sensing process to the suds removal process associated with a main washing cycle according to an embodiment of the present invention.
Figure 6:
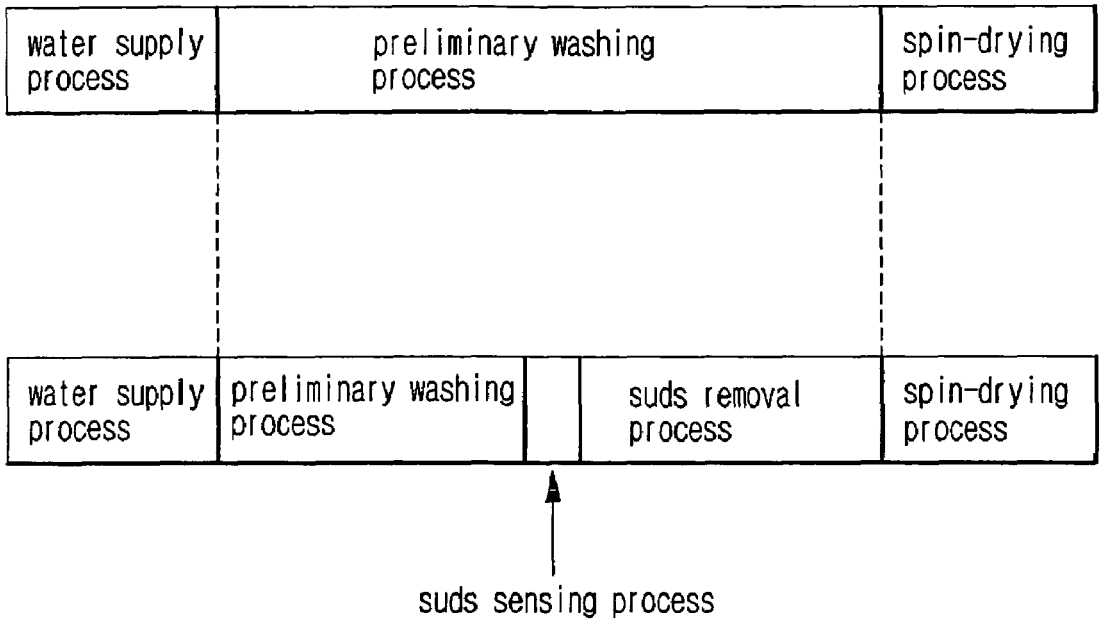
FIG. 6 is a flow chart illustrating a preliminary washing or main washing process of FIG. 3.
Figure 7:
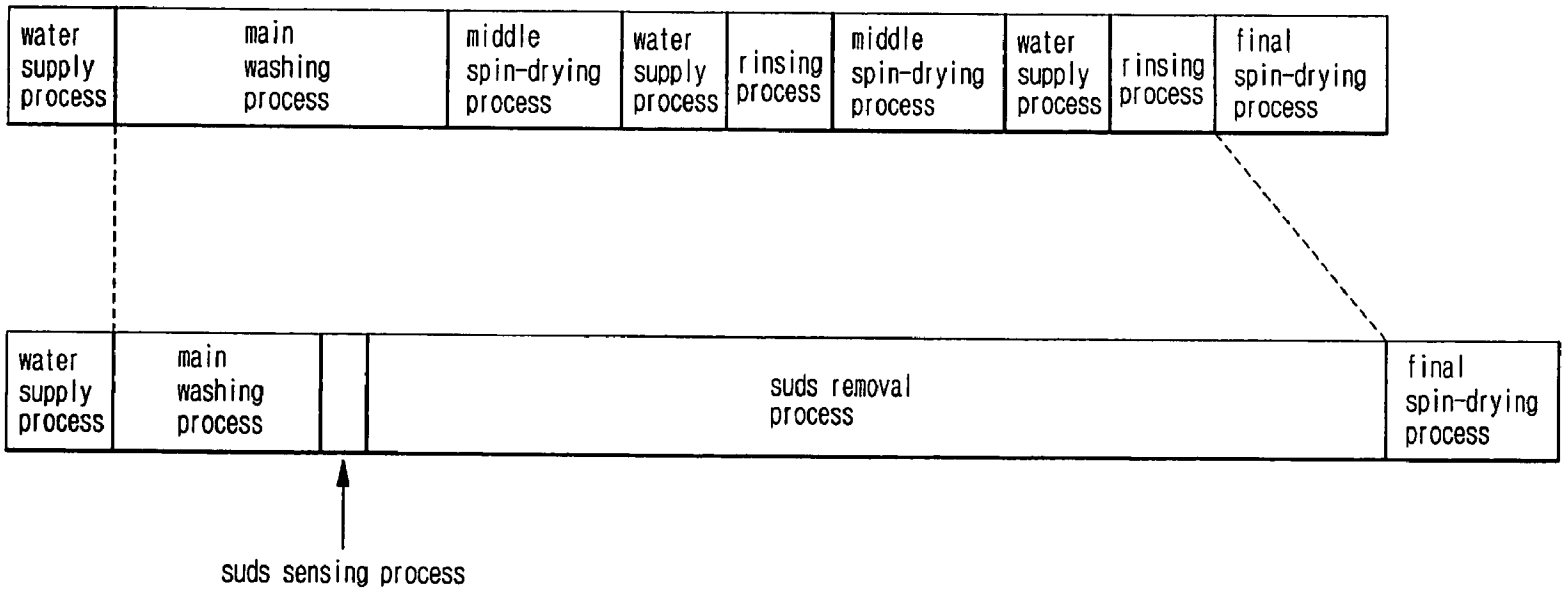
FIG. 7 is a flow chart illustrating the suds sensing process of FIG. 3.

FIG. 3 is a flow chart illustrating a suds removal method of the washing machine according to the present invention. FIG. 4 is a block diagram illustrating transition from a suds sensing process to a suds removal process associated with a preliminary washing cycle. FIG. 5 is a block diagram illustrating transition from a suds sensing process to a suds removal process associated with a main washing cycle.

The suds removal method of the present invention is an algorithm to effectively sense and remove suds generated during a preliminary washing or main washing cycle.

In operation, first, laundry is put into the rotating drum 12, and various operational information, such as a desired wash course, a temperature of wash water, revolutions per minute for a spin-drying cycle, and addition of a rinsing operation, is manually selected. The selected operational information is inputted to the controller 130 via the signal input unit 100.

According to the inputted operational information from the signal input unit 100, the controller 130 advances a preliminary washing cycle, a main washing cycle, and a rinsing cycle in this sequence. The preliminary washing, main washing, and rinsing cycles are identical to those of a general washing machine, and thus, a description thereof will be omitted hereinafter. The following description is based on a suds generating cycle, such as a preliminary washing cycle or main washing cycle.

In operation 100, when the preliminary washing or main washing cycle is initiated, the rotating drum 12 is rotated by driving of the motor 15 to wash laundry using a dropping force of the laundry while effectively agitating the laundry, detergent, and wash water. During this preliminary washing or main washing cycle, a torque variation of the motor 15 is detected to primarily sense the generation of suds.

When the generation of suds is primarily sensed, the washing cycle is forcibly ended. Then, from operation 100, the process moves to operation 200, where a suds sensing process begins, i.e. drainage process, as shown in FIGS. 4 and 5, and the drainage pump 19*c* is turned on to drain the water. In operation 200, whether the water reaches a drainage ending level within a predetermined drainage ending time $T_{end}$ in order to secondarily sense the generation of suds. Here, the drainage ending time $T_{end}$ is a time required to drain a maximum amount of water of each wash course.

When the water does not reach the drainage ending level within the predetermined drainage ending time $T_{end}$ during the suds sensing process, this means that suds have been generated. Thus, from operation 200, the process moves to operation 300, where the suds removal process to perform a suds removal cycle suitable for the preliminary washing or main washing cycle is completed.

Differently from a conventional suds removal method of repeatedly performing water supply, agitating(rinsing), drainage, and spin-drying operations under operation of the motor 15, the suds removal cycle of the present invention realizes an algorithm to remove suds at the earliest possible time using a small amount of water by artificially adjusting activity of the suds.

Now, operation 100, the preliminary washing or main washing process will be explained in detail with reference to FIG. 4.

FIG. 4 is a flow chart illustrating the preliminary washing or main washing process of FIG. 3.

When the washing machine is operated in a state wherein laundry is put into the rotating drum 12 and a detergent is filled in the detergent supply device 18, it is determined whether a preliminary washing cycle or main washing cycle is selected. Based on the determined washing cycle, in operation 110, the water supply valve 22 of the water supply device 20 is opened to supply water into the detergent supply device 18. Thereby, the detergent, inside the detergent supply device 18, is supplied into the water tub 11 in a dissolved state in the wash water that is supplied into the water tub 11 by way of the detergent supply device 18.

After completion of the water supply operation in operation 110, the process moves to operation 120, where a wetting operation is completed to effectively mix the wash water and the detergent supplied into the water tub 11 with the laundry is performed for approximately three minutes as the rotating drum 12 is rotated in a clockwise or counterclockwise direction by driving of the motor 15.

During the wetting operation, a torque of the motor 15, as a power source to rotate the rotating drum 12, is detected to calculate a maximum torque $T_{max}$ during the operation of the motor 15. The calculated maximum torque $T_{max}$ is stored in the controller 130 as a variable.

From operation 120, the process moves to operation 130, where an agitating operation is initiated after completion of the wetting operation, a torque of the motor 15 during the agitating operation is detected to calculate an average torque value $T_{avg}$ during operation of the motor 15.

By comparing the calculated average torque value $T_{avg}$ of the motor 15 during the agitating operation in operation 130, with the maximum torque value $T_{max}$ stored during the wetting operation, the process moves to operation 140, where it is determined whether the torque average value $T_{avg}$ of the motor 15 during the agitating operation is lower than the maximum torque value $T_{max}$ by more than a predetermined level of approximately 12%.

When the average torque value $T_{avg}$ of the motor 15 during the agitating operation is not lower than the maximum torque value $T_{max}$ by more than the predetermined level of approximately 12% in operation 140, the process moves to operation 150, where the preliminary washing or main washing cycle is continuously performed.

On the other hand, when it is determined that the average torque value $T_{avg}$ of the motor 15 during the agitating operation is lower than the maximum torque value $T_{max}$ by more than the predetermined level of approximately 12% in operation 140, this indicates that the torque of the motor 15 is reduced due to suds. Thus, the process moves to operation 160, where the generation of suds is primarily sensed, and the washing cycle is forcibly ended.

The sensing of suds using the torque variation of the motor 15 during the preliminary washing or main washing cycle, is largely affected by an input voltage. Thus, the torque of the motor 15 may fluctuate due to an unstable input voltage or a duty variation by change of the voltage. Therefore, it may be difficult to accurately sense suds.

For this reason, once the generation of suds is primarily sensed based on the torque variation of the motor 15 during the preliminary washing or main washing cycle, the suds removal method of the present invention progresses to the suds sensing process to accurately sense the generation of suds in operation 200 described below with reference to FIG. 5.

FIG. 5 is a flow chart illustrating the suds sensing process of FIG. 3. The most important object of the suds sensing process is to accurately sense whether suds are actually generated, prior to performing the suds removal process.

In operation 200, the suds sensing process, the drainage pump 19*c* is turned on to normally drain the wash water in operation 210, and from operation 210, the process moves to operation 220, where a drainage time $T_{cn}$ according to the operation of the drainage pump 19*c* is determined.

From operation 220, the process moves to operation 230, where it is determined whether the timed drainage time $T_{cn}$ is shorter than a predetermined drainage ending time $T_{end}$. The drainage ending time $T_{end}$ is approximately thirty seconds required to drain the maximum amount of water at a certain wash course.

If the timed drainage time $T_{cn}$ is greater than the drainage ending time $T_{end}$, it indicates the presence of suds because suds make it impossible to drain the water within the drainage ending time $T_{end}$. Thereby, the method progresses to operation 300, the suds removal process.

On the other hand, when the water reaches the drainage ending level within the predetermined drainage ending time $T_{end}$, it indicates that the water is normally drained within the drainage ending time $T_{end}$ due to the absence of suds in operation 230. From operation 230, the process moves to operation 240 where a post cycle is performed.

Operation 300, the suds removal process will now be explained with reference to FIG. 8.

Figure 8:
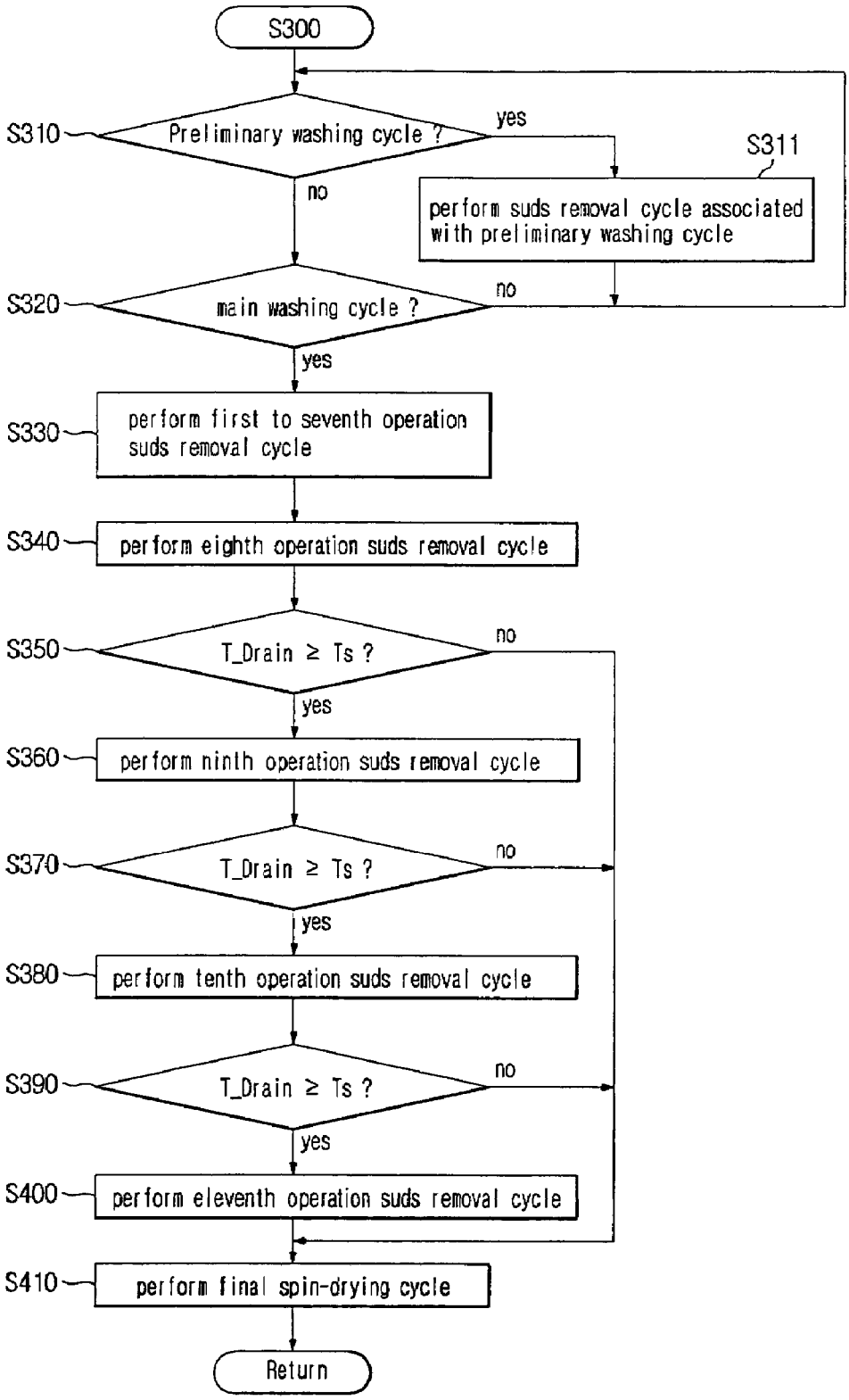
FIG. 8 is a flow chart illustrating the suds removal process of FIG. 3.

FIG. 8 is a flow chart illustrating the suds removal process of FIG. 3. The most important object of the suds removal process (i.e., operation 300) is to effectively remove suds at the earliest possible time using a small amount of water by artificially adjusting the activity of the suds. In the suds removal process, it is important to minimize the overall water and time consumption of the method that is inevitably prolonged by the suds removal process, although the suds removal process utilizes the water and time of the rinsing cycle.

Immediately after entering the suds removal process in operation 300, in operation 310 it is determined whether the present cycle is the preliminary washing cycle. If the present cycle is the preliminary washing cycle, the controller 130 performs a suds removal at pre-wash (hereinafter referred to as "SRAPW") cycle.

In the SRAPW cycle, when a "suds" mark is displayed to indicate the presence of suds, all drive units of the washing machine are kept in an idle state for a predetermined time of six minutes. This is done to wait sinkage of suds to increase a spin-drying success probability.

As will be easily understood, suds may be generated depending on the amount of a detergent during the main washing cycle. Thus, it is sufficient to reduce activity of suds during the preliminary washing cycle without removing the detergent.

The above idle time of six minutes is determined based on the fact that it takes approximately ten minutes at maximum to sense suds using the torque of the motor 15. Since the overall preliminary washing time is 16 minutes, the possible idle-state keeping time to reduce the activity of suds without an increase of the preliminary washing time is 6 minutes.

Admittedly, although it is desirable to determine an idle time without an increase of the overall preliminary washing time, a design criterion to reduce the activity of suds is preferable to keep the idle state for at least five minutes so as not to hinder the progress of the method to the next cycle.

Immediately after entering the suds removal process, operation 300, in operation 320, it is determined whether the present cycle is the main washing cycle. When the present cycle is the main washing cycle, the controller 130 performs a suds removal at main-wash (hereinafter referred to as "SRAMW") cycle (i.e., operations 330 through 400).

In the SRAMW cycle, when a "suds" mark is displayed to indicate the sensing of suds, water supply, agitating, spin-drying, and idling operations are repeatedly performed as the supply amount of water, and an operation rate and revolutions per minute (rpm) of the motor 15 are differently applied at each operation to conform to the activity of suds. Thereby, residual detergent in the water tub 11 and laundry is effectively removed.

That is, as shown in FIG. 5, when the generation of suds is sensed in the main washing cycle, the SRAMW cycle is performed instead of an existing rinsing cycle, and then, a final spin-drying cycle is directly performed.

A time used in the SRAMW cycle to remove suds is 71 minutes, and the amount of water used in that cycle is 94 liters. Admittedly, the time and the amount of used water vary depending on the capacity of a washing machine. In this case, since an existing rinsing time is 25 minutes and the amount of rinsing water is 40 liters under the assumption that the capacity of the washing machine is 5 kg, the overall wash time and the total amount of used water are substantially prolonged by, at maximum, 46 minutes and 54 liters.

In the present invention, however, the suds removal cycle may be ended at any time based on inspection results related to a residual amount of suds at each operation. Thus, the prolonged wash time and the prolonged amount of used water may be smaller than the maximum of 46 minutes and 54 liters (i.e., a design criterion of the time and the amount of water used during the SRAMW cycle must ensure normal operation even when a detergent is supplied to the maximum extent).

Figure 9:
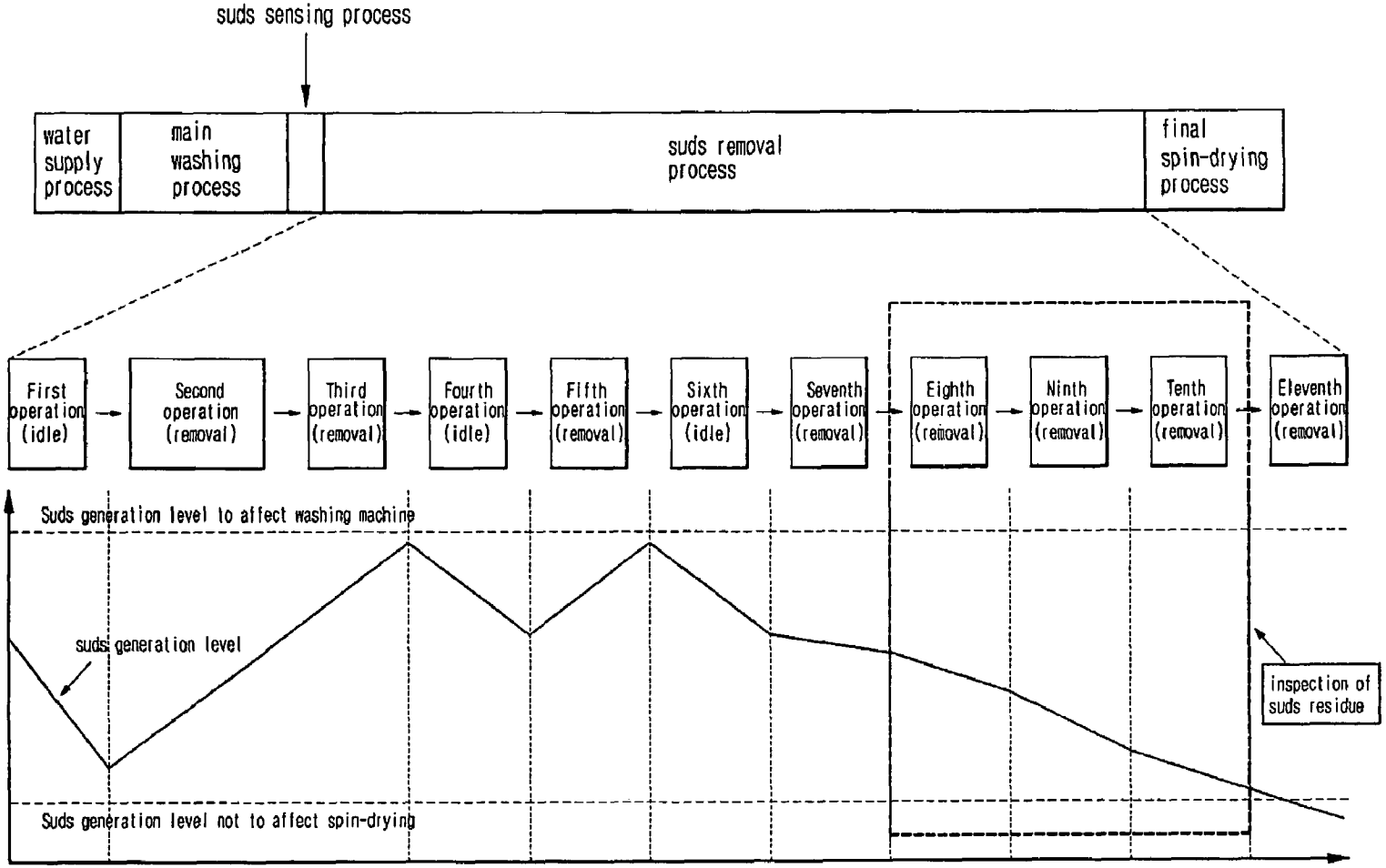
FIG. 9 is a graph illustrating an organization of respective operations of the suds removal cycle associated with the main washing cycle and the generation level of suds at each operation.
Figure 10:
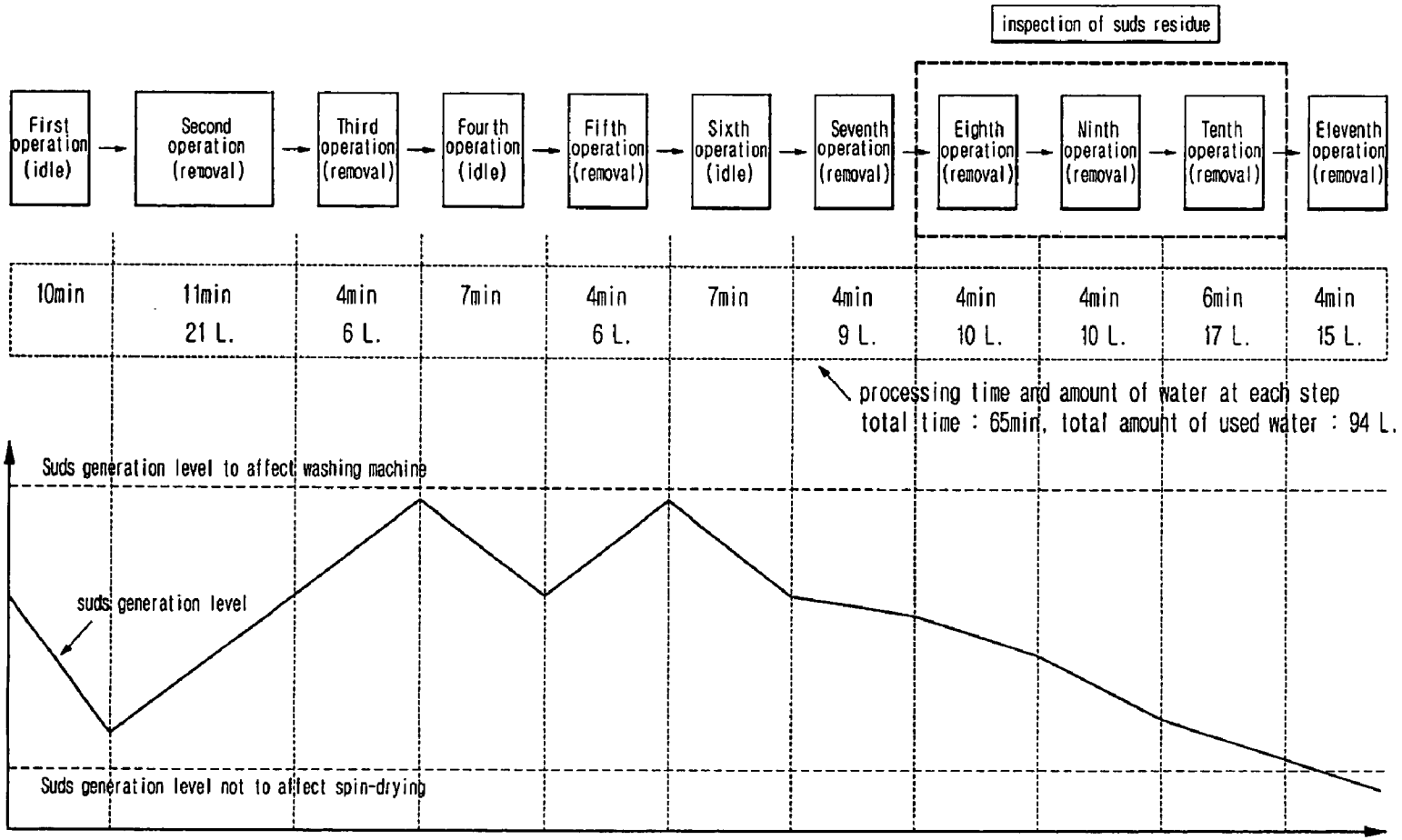
FIG. 10 is a graph illustrating the supply amount of water, processing time, and the generation amount of suds at each operation of the suds removal cycle associated with the main washing cycle.

The SRAMW cycle includes several operations as shown in FIGS. 9 and 10. The suds removal cycle is designed to artificially increase or decrease the generation amount of suds at each operation within a range not to affect operation of the washing machine, thereby enabling effective removal of the suds.

That is, from a first operation to a seventh operation of the suds removal cycle, activity of suds is repeatedly adjusted to increase the generation amount of suds or decrease the generation amount of suds by keeping all drive units in an idle state (operation 330 of FIG. 8).

Thereafter, from an eighth operation to a tenth operation of the suds removal cycle, it is determined whether the suds removal cycle will be continued or stopped by inspecting a residual amount of suds, prior to advancing to the next operation (i.e., operations 340 to 390).

When the suds are not completely removed even after completing the tenth operation, an eleventh operation is initiated to remove the suds using the amount of water, time, and operation rate of the motor, which are similar to those of a general rinsing cycle (operation 400 of FIG. 8).

After performing the SRAMW cycle as stated above, a final spin-drying cycle is performed in operation 410.

Now, each operation of the suds removal cycle will be described with reference to FIGS. 9 and 10.

Firstly, during the first, fourth, and sixth operations of the suds removal cycle, all drive units of the washing machine are kept in an idle state for a predetermined time in order to reduce activity of suds. A design criterion of these operations is to control the generation amount of suds so as not to hinder the progress of the suds removal cycle.

In the first, fourth, and sixth operations, substantially all the drive units except for the drainage pump 19*c* (shown in FIG. 1) are kept in an idle state. The drainage pump 19*c* is turned on for 15 seconds, and then is turned off for 20 seconds. The reason to successively turn on and off the drainage pump 19*c* is to rapidly sink suds although it is also effectively to limit a temperature rising of the drainage pump 19*c*.

When the drainage pump 19*c* is continuously kept in an "on" state, a pressure variation inside the water tub 11 is constant, causing suds to be drained based on a natural sinking speed thereof. However, by successively turning on and off the drainage pump 19*c*, the water tub 11 is subjected to pressure variation therein, thereby allowing a sinking speed of suds to be artificially increased.

Secondly, during a second operation of the suds removal cycle, water supply, agitating, and drainage operations are successively performed using a relatively small amount of water, for example, 21 liters, under a relatively high operation rate of the motor 15. The object of the second operation is not to remove a detergent adhered to laundry, but to remove a detergent remaining in the water tub 11.

Figure 11:
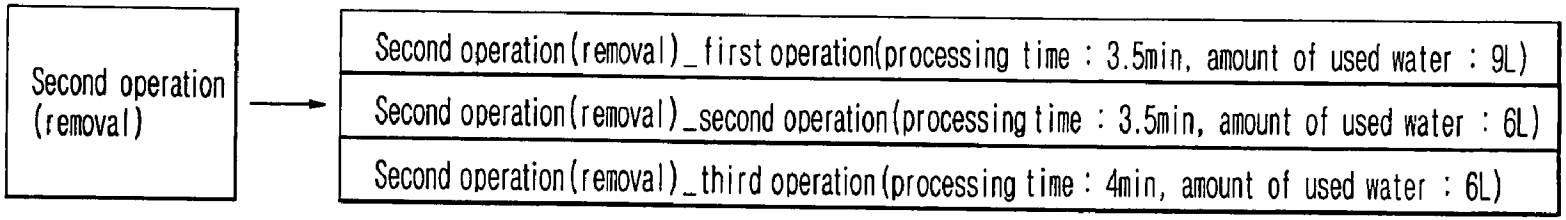
FIG. 11 is a block diagram illustrating organization of a second operation of the suds removal cycle associated with the main washing cycle.

The second operation is divided into first to third sub-operations as shown in FIG. 11. The first to third sub-operations are identical to one another in their general operation, but have different processing times and use different amounts of water.

In the second operation, as a small amount of water is repeatedly supplied into or drained from the water tub 11, a detergent remaining in the water tub 11, rather than a detergent adhered to laundry, is able to be removed. Hereinafter, the second operation will be further described in more detail in association with the first sub-operation.

During the water supply operation of the second operation, bleach or rinse agent is forcibly inputted into the water tub 11.

Since the suds removal method does not separately perform an existing rinsing cycle, the bleach or rinse agent must be forcibly inputted at an appropriate time point. The bleach or rinse agent plays an important role in the removal of suds.

When the bleach or rinse agent is inputted upon sensing of suds, they act to promptly vanish suds, enabling removal of suds using minimum of water.

Figure 12:
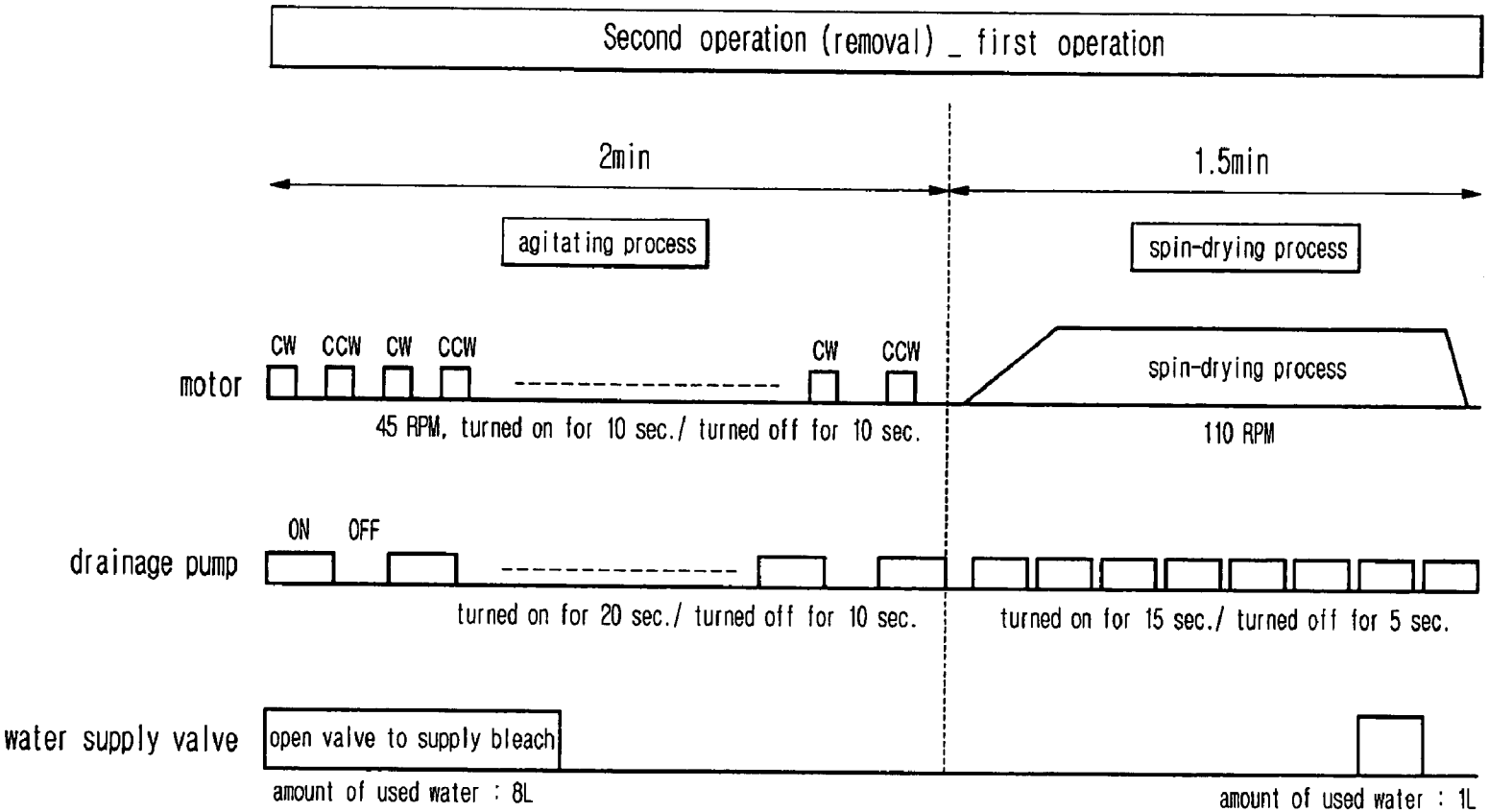
FIG. 12 is a diagram illustrating operation of a drive unit in the second operation of the suds removal cycle associated with the main washing cycle of FIG. 11.

As shown in FIG. 12, the first sub-operation of the second operation is divided into an agitating interval and a spin-drying interval.

Considering first the agitating interval, it is kept for 2 minutes, and the motor is operated at 45 rpm. Also, the motor is turned on and off every 10 seconds, showing an operation rate of 50%. The drainage pump is turned on for 20 seconds and turned off for 10 seconds. The supply amount of water is 8 liters, and bleach is forcibly inputted during the water supply operation (See FIG. 12).

Next, in the case of the spin-drying interval, it is different in time and revolutions per minute of the motor at each sub-operation. That is, in the case of the first and second sub-operations, the spin-drying interval is 1.5 minutes and the motor is operated at 110 rpm, while in the case of the third sub-operation, the spin-drying interval is 2 minutes and the motor is operated at 120 rpm. The drainage pump is turned on for 15 seconds and turned off for 5 seconds. The supply of water is performed 10 seconds before ending of the spin-drying interval, and the supply amount of water is 1 liter (See FIG. 12).

The second and third sub-operations of the second operation are identical to the first sub-operation in general operation, but are increased in the spin-drying interval and the total amount of used water so as to facilitate the generation level of suds.

Thirdly, during third, fifth, and seventh operations, a relatively large amount of water is supplied, and simultaneously, the motor is operated at a relatively low operation rate for agitating operation. Differently from the second operation, the object of these operations is to remove a residual detergent adhered to laundry.

To remove the residual detergent adhered to laundry rather than the detergent remaining in the water tub 11, the third, fifth, and seventh operations are designed to enhance activity of suds to the maximum extent by increasing the supply amount of water and revolutions per minute of the motor 15. Since these operations have no drainage interval, and induce a relatively rapid increase in the generation of suds, the operation rate of the motor is lowered as compared to the remaining operations.

Although the third, fifth, and seventh operations are similar to eighth to tenth operations, which will be described hereinafter, in operation and general design concept thereof, they have a difference in that they do not involve drainage of detergent. Thus, the third, fifth, and seventh operations must be performed using a relatively small amount of water and at a low operation rate of the motor as compared to the eighth to tenth operations. The third, fifth, and seventh operations are similar to one another in general operation, and thus, only the third operation will now be explained in detail.

During the water supply operation of the third operation, bleach or rinse agent is forcibly inputted.

Since the suds removal method does not separately perform an existing rinsing cycle, the bleach or rinse agent must be forcibly inputted at an appropriate time point. The reason to forcibly input the bleach or rinse agent was previously explained hereinbefore.

Figure 13:
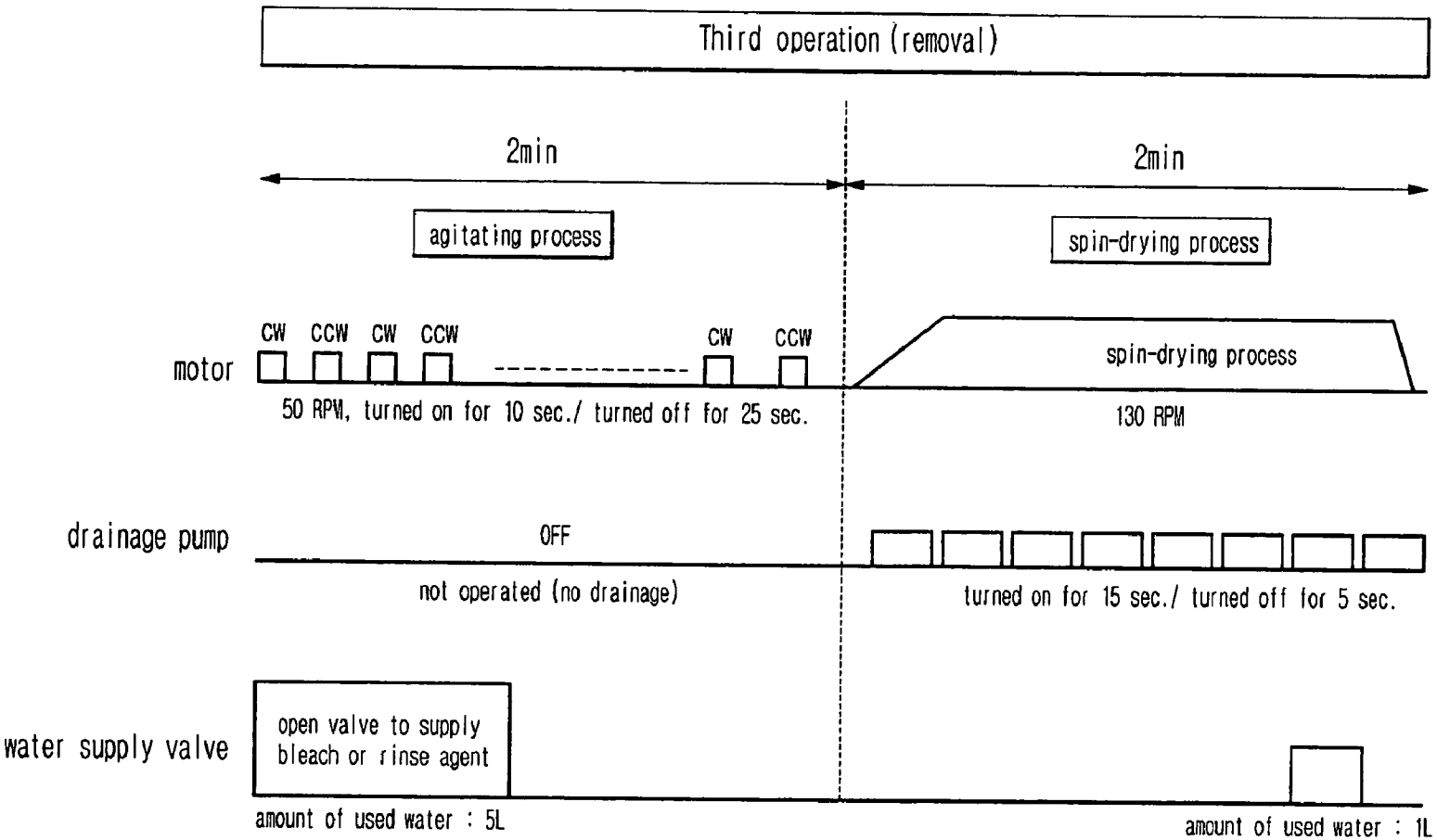
FIG. 13 is a diagram illustrating an operation of the drive unit in a third operation of the suds removal cycle associated with the main washing cycle.

As shown in FIG. 13, the third operation is divided into an agitating interval and a spin-drying interval.

The agitating interval of the third operation is kept for 2 minutes, and the motor is operated at 50 rpm. The motor is turned on for 10 seconds and turned off 15 seconds, showing an operation rate of 40%. During the agitating interval, the drainage pump is not operated. This means that there is no drainage of water 5 liters of water is supplied, and the bleach or rinse agent is forcibly inputted during the water supply operation (See FIG. 13).

Next, the spin-drying interval of the third operation is kept for 2 minutes, and the motor is operated at 130 rpm. The drainage pump is turned on for 15 seconds and turned off for 5 seconds 1 liter of water is supplied 10 seconds before ending of the spin-drying interval (See FIG. 13).

Fourthly, the eighth to tenth operations are designed to increase activity of suds to the maximum extent by supplying the maximum amount of water and operating the motor at the highest operation rate for agitating operation, thereby removing residual detergent and suds in both the water tub 11 and laundry. While performing each operation, a residual amount of suds is checked to determine whether the suds removal cycle should be continued or ended. If the suds are insufficiently reduced even after the tenth operation is ended, finally, the eleventh operation will be progressed.

The object of the eighth to tenth operations is to enhance activity of suds to the maximum extent as compared to the remaining operations by increasing the supply amount of water and the operation rate of the motor, thereby removing residual detergent and suds in the water tub 11 and laundry to the maximum extent. In this case, a residual amount of detergent and suds is checked at an ending time point of each operation to determine whether the suds removal cycle should be ended or progressed to a next operation.

Although the eighth to tenth operations are similar to the third, fifth, and seventh operations in operation and general design concept thereof, they are designed to remove suds using the maximum amount of water and the highest operation rate and revolutions per minute of the motor since the third, fifth, and seventh operations have a low generation possibility of suds insufficient to affect the operation of the washing machine. The reason to employ the maximum amount of water and the highest operation rate and revolutions per minute of the motor is to maximize activity of suds to thereby prevent malfunction when a residual amount of suds is checked at the ending time point of each operation. Since the eighth to tenth operations are similar to one another in general operation, only the eighth operation will now be explained in detail.

During the water supply operation of the eighth operation, a rinse agent is forcibly inputted.

Figure 14:
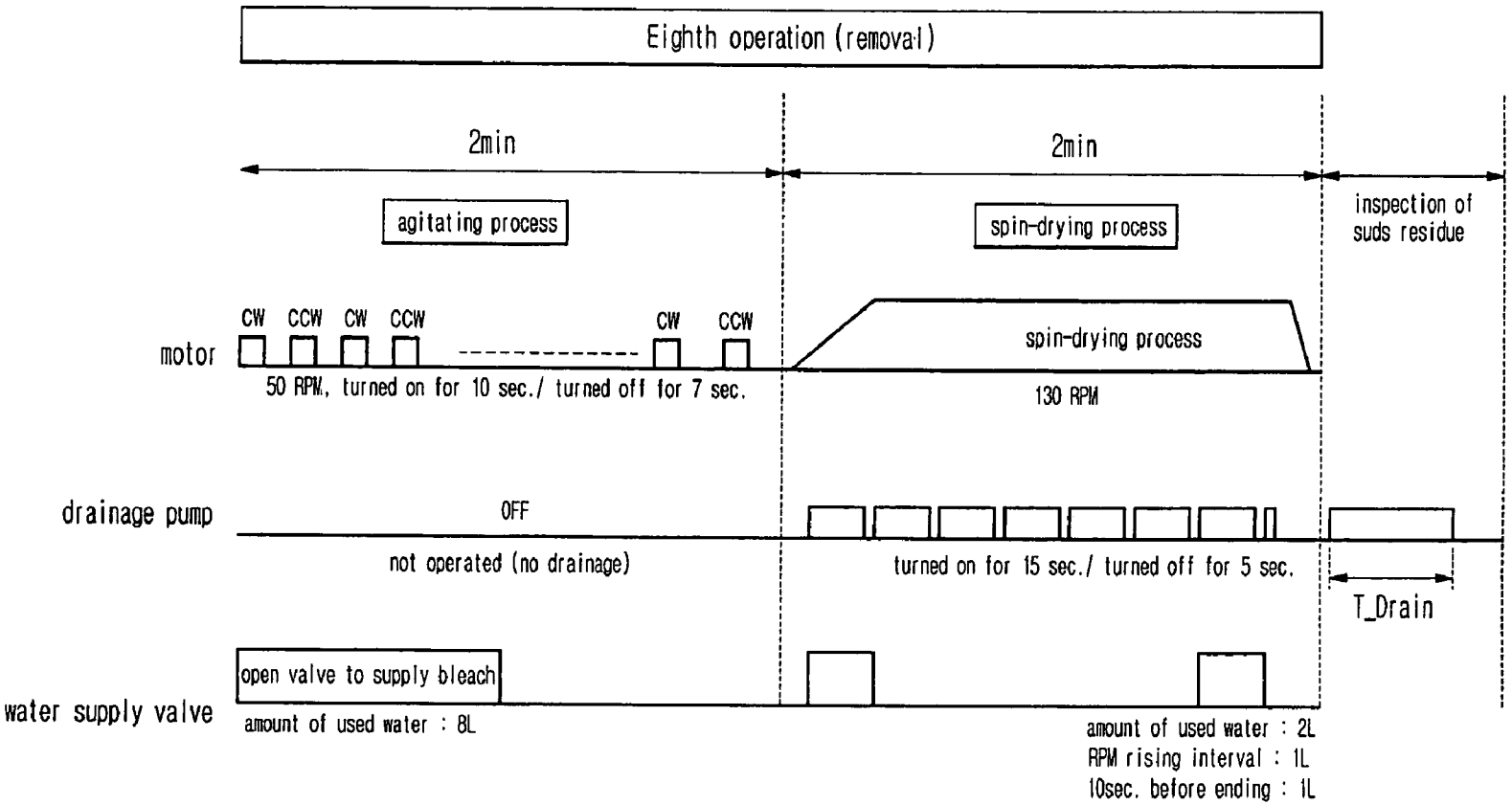
FIG. 14 is a diagram illustrating an operation of the drive unit in an eighth operation of the suds removal cycle associated with the main washing cycle.

As shown in FIG. 14, the eighth operation is divided into an agitating interval and a spin-drying interval.

The agitating interval of the eighth operation is kept for 2 minutes, and the motor is operated at 50 rpm. The motor is turned on for 10 seconds and turned off 7 seconds, showing an operation rate of 58%. During the agitating interval, the drainage pump is not operated. This means that there is no drainage of water. 8 liters of water is supplied, and the rinse agent is forcibly inputted during the water supply operation (See FIG. 14).

Next, the spin-drying interval of the third operation is kept for 2 minutes, and the motor is operated at 130 rpm. The drainage pump is turned on for 15 seconds and turned off for 5 seconds. The water is supplied 10 seconds before ending of the spin-drying interval upon an increase of revolutions per minute of the motor, and 1 liter of water is supplied at each operation (See FIG. 14).

The inspection of a residual amount of suds in the eighth to tenth operations will be performed as follows.

After activating suds to the maximum extent during the agitating interval of the eighth operation as shown in FIG. 14, water is forcibly supplied upon an increase of revolutions per minute of the motor and at an ending time point of the spin-drying interval so as to again activate the suds. When the drainage pump 19*c* is continuously operated after the completion of the spin-drying interval, a time T_drain required to reach a predetermined drainage ending level (reset level) increases if a relatively large amount of suds remains. When suds are sufficiently removed, the time T_drain required to reach the predetermined drainage ending level is not more than 10 seconds. Admittedly, the time T_drain may increase depending on the amount of generated suds. Therefore, in the present invention, the time T_drain is set to 15 seconds. When the time T_drain exceeds 15 seconds (in operations 350, 370, and 390 of FIG. 8), the method is progressed to a next operation. Conversely, when the drainage time T_drain is less than 15 seconds, the suds removal cycle is ended, and directly, a final spin-drying cycle is progressed (operation 410 of FIG. 8).

Of course, the drainage time T_drain is variable according to the capacity of a washing machine.

Fifthly, the eleventh operation is performed when the greatest amount of suds is generated. If the amount of generated suds is relatively small, the suds removal cycle will be ended before the eleventh operation. The eleventh operation is finally performed when the greatest amount of suds is generated using the amount of water, removal time, and operation rate of the motor, which are similar to those of a general rinsing cycle. The eleventh operation is designed to sufficiently remove the greatest amount of suds based on the maximum amount of detergent.

The eleventh operation performs a rinsing operation, and the amount of water and the operation rate of the motor during the rinsing operation depends on the character of each wash course. The design object of the eleventh operation is to finally remove suds remained even after performing the above-described former operations. Only when the suds removal cycle of the present invention is progressed to the eleventh operation, a "suds" mark is displayed upon ending of all cycle. If it is confirmed via inspection of a residual amount of detergent that suds is sufficiently removed during the suds removal cycle, the "suds" mark is not displayed after ending of all cycle.

The eleventh operation must be designed to ensure smooth implementation of a final spin-drying cycle after completing thereof even when the maximum amount of detergent is inputted into the washing machine. Depending on the residual amount of suds, the eleventh operation may be performed or not.

The present invention provides a washing machine and suds removal method thereof, which can remove suds at the earliest possible time using a small amount of water by adjusting activity of suds upon generation thereof. Also, by differently adjusting the supply amount of water and the operation rate of a motor at each operation of a suds removal cycle, residual detergent remaining in a water tub and laundry can be effectively removed.

Further, according to the present invention, by inspecting a residual amount of suds in the middle of the suds removal cycle, the suds removal cycle may be continued or ended depending on the inspection results. This has the effect of reducing unnecessary time and water consumption. The washing machine displays a "suds" mark only when suds are sensed via the inspection of the residual amount of suds performed in the middle of the suds removal cycle. This prevents misunderstanding due to display of unnecessary operational mode of the washing machine.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A suds removal method of a washing machine comprising:

sensing a generation of suds during a washing cycle; and removing the suds by adjusting an activity of the suds depending on the supply amount of water and/or an operation rate of the motor when the generation of suds is sensed, wherein the sensing of the generation of suds comprises primarily sensing the generation of suds by detecting a torque variation of a motor during the washing cycle; and secondarily sensing the generation of suds by performing a drainage operation after ending the washing cycle when the generation of suds is primarily sensed and determining whether water reaches a drainage ending level within a predetermined drainage time during the drainage operation.

2. The method according to claim 1, wherein the primary sensing of the generation of suds is performed by determining whether a torque of the motor is reduced beyond a predetermined variation rate, thereby sensing the generation of suds when the torque of the motor is reduced below the predetermined variation rate.

3. The method according to claim 2, wherein the predetermined variation rate is approximately 10%.

4. The method according to claim 1, wherein the secondarily sensing of the generation of suds is performed by sensing the generation of suds when the water does not reach the drainage ending level within the predetermined drainage time.

5. The method according to claim 1, wherein the washing cycle is a preliminary washing cycle or main washing cycle.

6. The method according to claim 5, wherein the removal of suds comprises:

determining whether the washing cycle is the preliminary washing cycle; and stopping operation of all drive units when the washing cycle is the preliminary washing cycle, thereby lowering the activity of suds.

7. The method according to claim 5, wherein the removal of suds comprises:

determining whether the washing cycle is the main washing cycle; and performing a suds removal cycle when the washing cycle is the main washing cycle, to differently adjust the activity of suds at each operation of the suds removal cycle, thereby removing the suds.

8. The method according to claim 7, wherein the suds removal cycle comprises:

washing to remove a detergent remaining in a water tub by successively performing water supply, agitating, and drainage operations;

washing to remove a detergent remaining in laundry by successively performing water supply and agitating operations; and removing the detergent remaining in the water tub and laundry by increasing the supply amount of water and an operation rate of the motor while successively performing the water supply and agitating operations.

9. The method according to claim 8, wherein the suds removal cycle reduces the activity of suds by inputting a bleach or rinse agent during the water supply operation.

10. The method according to claim 8, wherein the suds removal cycle further includes rinsing the suds remaining in the water tub and the laundry by successively performing the water supply and agitating operations.

11. The method according to claim 8, wherein the removing the detergent remaining in the water tub and the laundry comprises determining whether the suds removal cycle is to be continued or stopped by inspecting a residual amount of the suds in the middle of the suds removal cycle.

12. The method according to claim 11, wherein the removing of the detergent remaining in the water tub and the laundry further comprises displaying a "suds" mark that indicates the presence of suds when the residual amount of suds is sensed in the suds residue inspection.

13. The method according to claim 11, wherein the removing of the detergent remaining in the water tub and the laundry further comprises measuring a time required to reach a drainage ending level when a drainage pump is continuously turned on after completing a spin-drying cycle, thereby stopping the suds removal cycle when water reaches the drainage ending level within a predetermined drainage time.

14. The method according to claim 13, wherein the suds removal cycle further comprises rinsing when the water does not reach the drainage ending level within the predetermined drainage time.

15. The method according to claim 8, wherein the suds removal cycle further comprises idling to reduce the activity of suds via a pressure variation inside the water tub by controlling turning on/off of a drainage device.

16. The method according to claim 15, wherein the idling to reduce the activity of suds comprises stopping all the drive units except for the drainage device.

* * * * *